US012441439B2

(12) United States Patent
Fricker

(10) Patent No.: US 12,441,439 B2
(45) Date of Patent: Oct. 14, 2025

(54) DEVICE FOR COLLAPSIBLY SUPPORTING A COVER, AN ASSOCIATED COVERING AND A METHOD OF OPERATING SAME

(71) Applicant: Glyn Fricker, San Diego, CA (US)

(72) Inventor: Glyn Fricker, San Diego, CA (US)

( * ) Notice: Subject to any disclaimer, the term of this patent is extended or adjusted under 35 U.S.C. 154(b) by 489 days.

(21) Appl. No.: 18/002,839

(22) PCT Filed: Jun. 22, 2021

(86) PCT No.: PCT/AU2021/050648

§ 371 (c)(1),
(2) Date: Dec. 21, 2022

(87) PCT Pub. No.: WO2021/258137

PCT Pub. Date: Dec. 30, 2021

(65) Prior Publication Data

US 2023/0242219 A1 Aug. 3, 2023

(30) Foreign Application Priority Data

Jun. 23, 2020 (AU) ..... 2020902080

(51) Int. Cl.

| | |
|---|---|
| ***B63B 17/02*** | (2006.01) |
| ***B63B 7/08*** | (2020.01) |
| ***E04H 15/44*** | (2006.01) |

(52) U.S. Cl.
CPC ..... *B63B 17/02* (2013.01); *B63B 7/085* (2013.01); *E04H 15/44* (2013.01)

(58) Field of Classification Search
CPC ..... B63B 17/02; B63B 7/085; E04H 15/44; E04H 15/02; E04H 15/26; E04H 15/28;
(Continued)

(56) References Cited

U.S. PATENT DOCUMENTS 3,205,904 A * 9/1965 Kreachbaum ..... A45B 19/00 135/15.1
3,794,054 A * 2/1974 Watts ..... E04H 15/28 135/117

(Continued)

FOREIGN PATENT DOCUMENTS

CN 107997320 A 5/2018
DE 202010010017 U1 11/2010

(Continued)

*Primary Examiner* — Anthony D Wiest
(74) *Attorney, Agent, or Firm* — The Inventor's Friend Patent Law Firm, P.L.L.C.; Nathaniel A. Wickliffe, Patent Attorney

(57) ABSTRACT

A device for collapsibly supporting a cover, comprising a mount and one or more resilient and substantially radial spars arranged to pivot relative to the mount, wherein a first end of the or each spar is associated with the mount and a second opposite end is configured to secure to an outer end of the cover, wherein in use, the device is movable from a collapsed state for stowage of the cover, to an open state, wherein: (a) the or each spar extends outwardly from the mount to spread the cover; and (b) tension is applied to an outer region of the cover, thereby drawing the second end of the or each spar downwardly such that the or each spar deflects and urges the cover upwardly and away from a plane defined by the perimeter of the opened cover.

17 Claims, 15 Drawing Sheets

(58) Field of Classification Search
CPC ... E04H 15/00; E04H 15/38; E04H 2015/326; E04F 10/10; E04B 2001/3241; E04B 1/3211; A45B 19/00
See application file for complete search history.

(56) References Cited

U.S. PATENT DOCUMENTS

| | | | | |
|---|---|---|---|---|
| 4,836,232 | A | 6/1989 | De Rosa | |
| 5,441,066 | A * | 8/1995 | Harris | E04H 15/28 135/98 |
| 2006/0107980 | A1 * | 5/2006 | Freestone | A45B 23/00 135/20.1 |
| 2007/0283991 | A1 | 12/2007 | Sherts | |

FOREIGN PATENT DOCUMENTS

| | | | |
|---|---|---|---|
| FR | 2627368 | A1 | 8/1989 |
| WO | WO9807937 | A1 | 2/1998 |
| WO | 2011037450 | A2 | 3/2011 |

* cited by examiner

DEVICE FOR COLLAPSIBLY SUPPORTING A COVER, AN ASSOCIATED COVERING AND A METHOD OF OPERATING SAME

FIELD OF THE INVENTION

The present invention relates to a device for collapsibly supporting a cover, an associated covering and a method of operating same.

BACKGROUND

Existing coverings, such as outdoor awnings, cantilevered umbrellas, boat covers and the like can be cumbersome and difficult to install and operate. Additionally, they may lack in portability, especially when they are large and used to shield, shade or cover relatively large regions such as boats and patios. Moreover, existing coverings are typically limited to a single application; for example, existing boat covers are not readily adaptable to be used as an outdoor awning or patio cover. As such, existing coverings fall short when it comes to their operation, functionality and versatility.

There is a need to address the above, and/or at least provide a useful alternative.

SUMMARY

According to a first aspect of the present invention, there is provided a device for collapsibly supporting a cover, comprising a mount and one or more resilient and substantially radial spars arranged to pivot relative to the mount, wherein a first end of the or each spar is associated with the mount and a second opposite end is configured to secure to an outer end of the cover, wherein in use, the device is movable from a collapsed state for stowage of the cover, to an open state, wherein:

(a) the or each spar extends outwardly from the mount to spread the cover; and (b) tension is applied to an outer region of the cover, thereby drawing the second end of the or each spar downwardly such that the or each spar deflects and urges the cover upwardly and away from a plane defined by the perimeter of the opened cover.

According to embodiments of the invention, at least one spar is retractable for stowage of the cover in the collapsed state, and extendable for spreading the cover in the open state.

According to embodiments of the invention, the device comprises two or more spars, at least one of which is pivotal about the mount and relative to the other spar(s).

According to embodiments of the invention, each spar is configured to be pivotal about the mount such that:

(a) in the collapsed state, each spar generally extends in a common radial direction; and (b) in the open state, each spar is pivoted about the mount so as to be angularly spaced from another spar.

According to embodiments of the invention, the spars are arranged to secure to respective regions of the cover such that, in use, when the spars are moved to the open state, the spars spread open frontal and lateral regions of the cover.

According to embodiments of the invention, the device further comprises a tensioning means configured to secure to a rearward region of the cover and to be operable to collapse and open the rearward region of the cover in the collapsed and open states, respectively.

According to embodiments of the invention, the tensioning means is pivotal relative to the mount from a folded state for stowage of the cover, to an unfolded state for opening the rearward region of the cover and drawing the opened cover tight.

According to embodiments of the invention, the device further comprises a stopping means configured to maintain the or each spar at a substantially similar angular position when the device is moved to the collapsed state.

According to embodiments of the invention, the device further comprises a limiting means configured to limit the maximum angular displacement of the or each spar to a respective and predetermined angular position when the device is moved to the open state.

According to embodiments of the invention, wherein tension is applied to the outer region of the cover by securing one or more outer locations of the cover via one or more anchor points to tighten and draw the cover downwardly.

According to embodiments of the invention, the mount is pivotal to enable angular adjustment of the plane defined by the perimeter of the opened cover.

According to embodiments of the invention, the mount is angled from the normal to the plane defined by the perimeter of the opened cover. For example, it is envisaged that the mount may be configured or moved such that a longitudinal axis thereof is parallel to the plane.

According to a second aspect of the invention, there is provided a covering comprising:

(a) a device according to a first aspect of the invention; and (b) a cover secured to the device via the or each spar thereof.

According to a third aspect of the invention, there is provided a method of opening a covering according to a second aspect of the invention from a collapsed state to an open state, the method comprising:

(a) pivoting the or each spar about the mount so as to at least partially spread open frontal and lateral regions of the cover; and (b) applying tension to an outer region of the cover, thereby drawing the second end of the or each spar downwardly such that the or each spar deflects and urges the cover upwardly and away from a plane defined by the perimeter of the opened cover.

According to embodiments of the invention, the method further comprises:

(c) as the or each spar is pivoted open to spread the cover open, operating the tensioning means to open the rearward region of the covering, thereby imparting tension to the cover.

According to a fourth aspect of the invention, there is provided a boat cover kit comprising:

(a) a covering according to a second aspect of the invention; and (b) a carrier in which at least a portion of the covering is stowable and/or to which the covering is securable, wherein the covering is deployable from the carrier to substantially cover the boat.

According to embodiments of the invention, the kit further comprises a base mount to which the mount of the device is secured, which base mount is securable to the boat.

According to a fifth aspect of the invention, there is provided a method of using a boat cover kit according to a fourth aspect of the invention, comprising:

securing the base mount to a boat; and securing a first end of the carrier to the boat such that the covering is at least partially stowed therein.

According to embodiments of the invention, the method further comprises securing a first end of the at least partially stowed cover of the covering to the boat.

According to embodiments of the invention, the method further comprises opening the carrier and deploying the covering from the carrier so as to substantially cover the boat.

According to embodiments of the invention, the method further comprises securing a second end of the deployed covering to the boat.

BRIEF DESCRIPTION OF THE DRAWINGS

In order that the invention may be more easily understood, an embodiment will now be described, by way of example only, with reference to the accompanying drawings in which:

FIG. 8(*b*) shows a rear perspective view of the mechanism of FIG. 8(*a*) in a deployed state;

FIG. 12(*b*) shows a bottom perspective view of the device shown in FIG. 12(*a*);

FIG. 17(*b*) shows a front perspective view of the covering of FIG. 17(*a*) in a first partially deployed state;

FIG. 18(*b*) shows a front perspective view of the covering of FIG. 18(*a*) in a deployed or opened state;

FIG. 19(*b*) shows a close-up rear view an embodiment of a covering partially stored in a carry bag, a device thereof being mounted to a boat;

DETAILED DESCRIPTION

Figure 1:
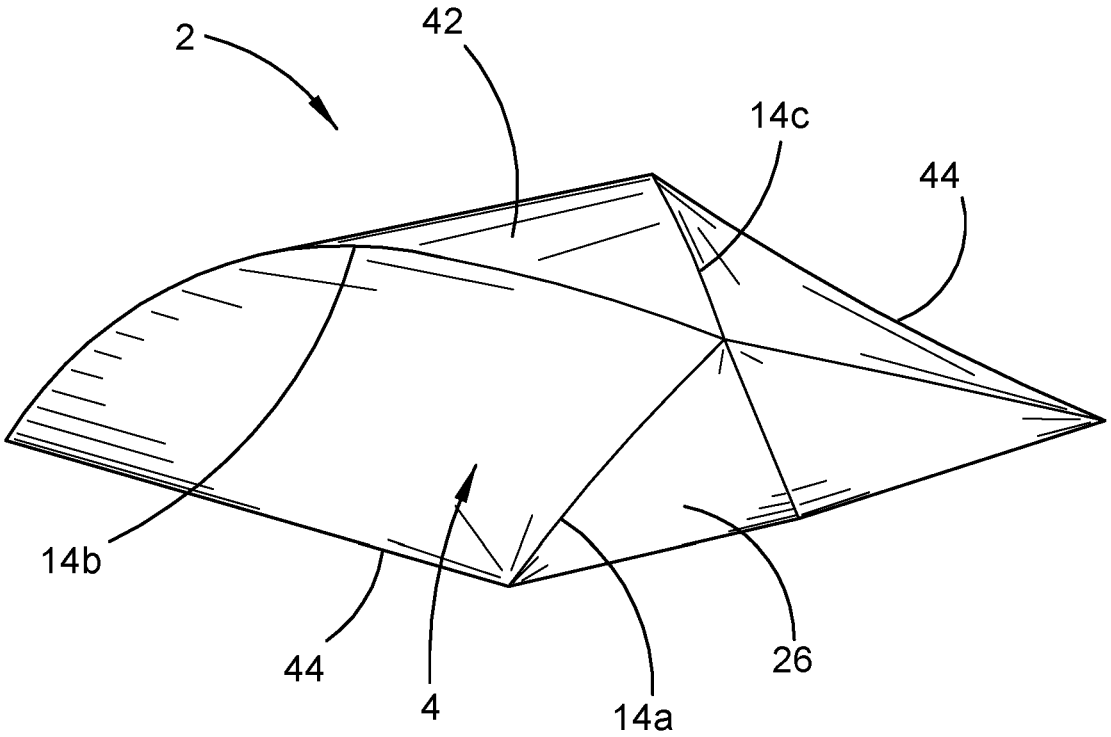
FIG. 1 is a side perspective view of a deployed or opened covering according to embodiments of the present invention.

A covering 2 according to an embodiment of the invention is shown in FIG. 1. The covering 2 comprises a cover 4 made from a flexible and/or deformable material which is releasably secured to a device 6 operable to collapse and expand the cover 4.

Figure 2:
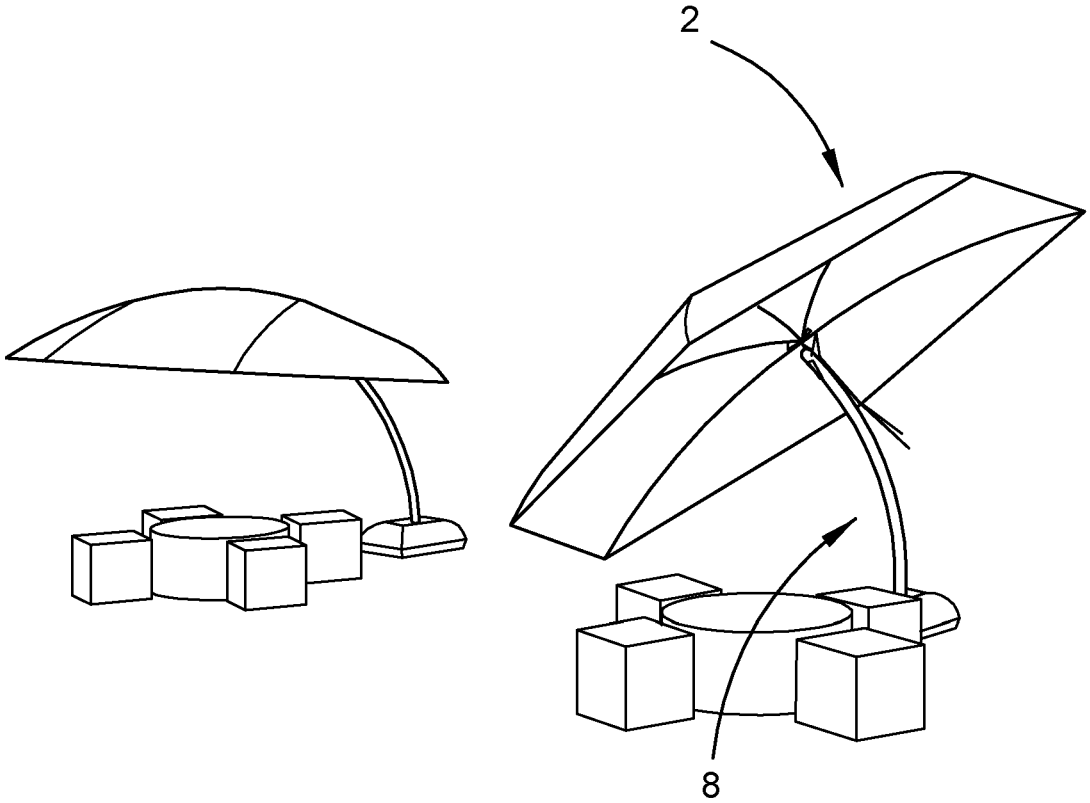
FIG. 2 is a rear perspective view of coverings according to embodiments of the present invention adapted for use in an outdoor shading application.
Figure 3:
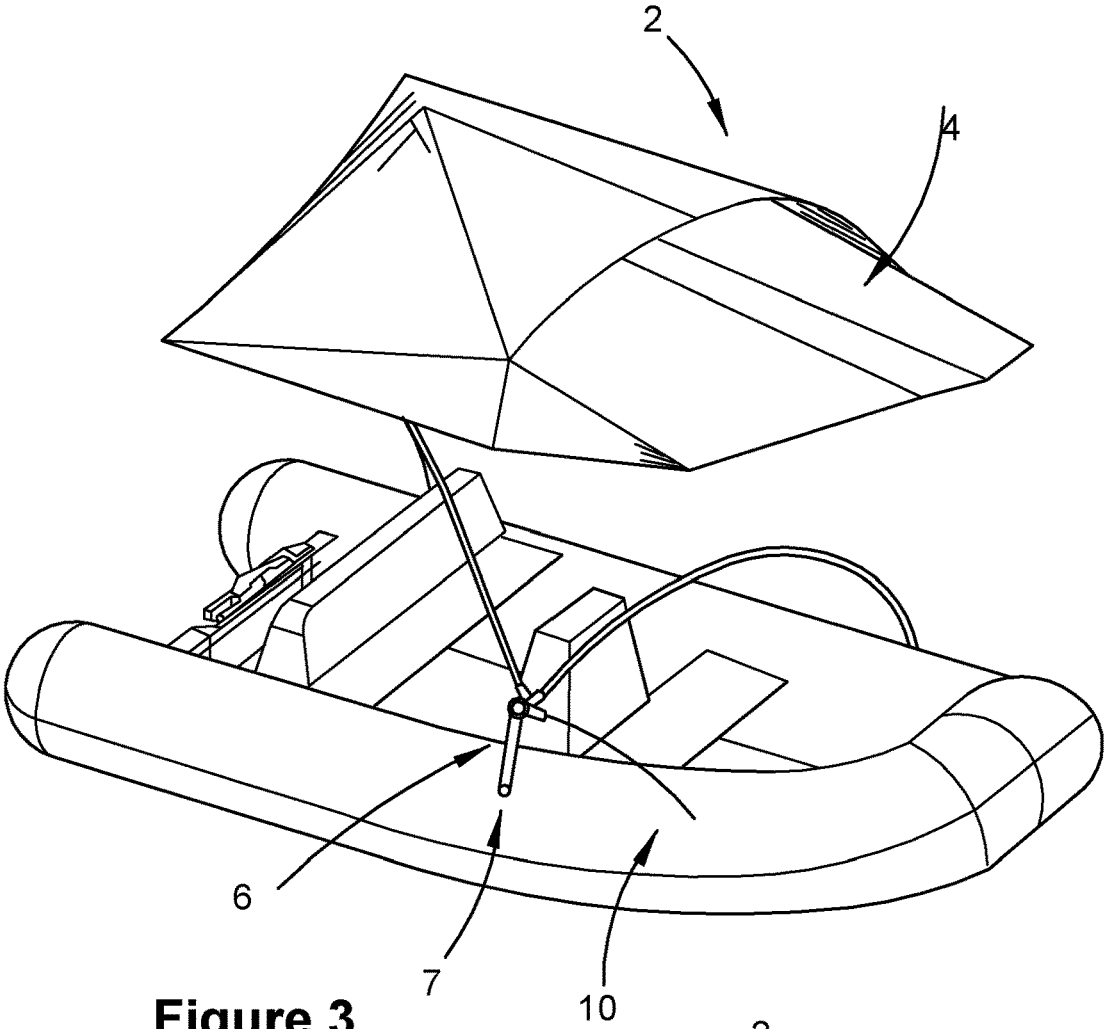
FIG. 3 is a rear perspective view of an inflatable tender boat to which is secured a deployed a protective covering according to embodiments of the present invention, the covering shown with a cutaway view.
Figure 4:
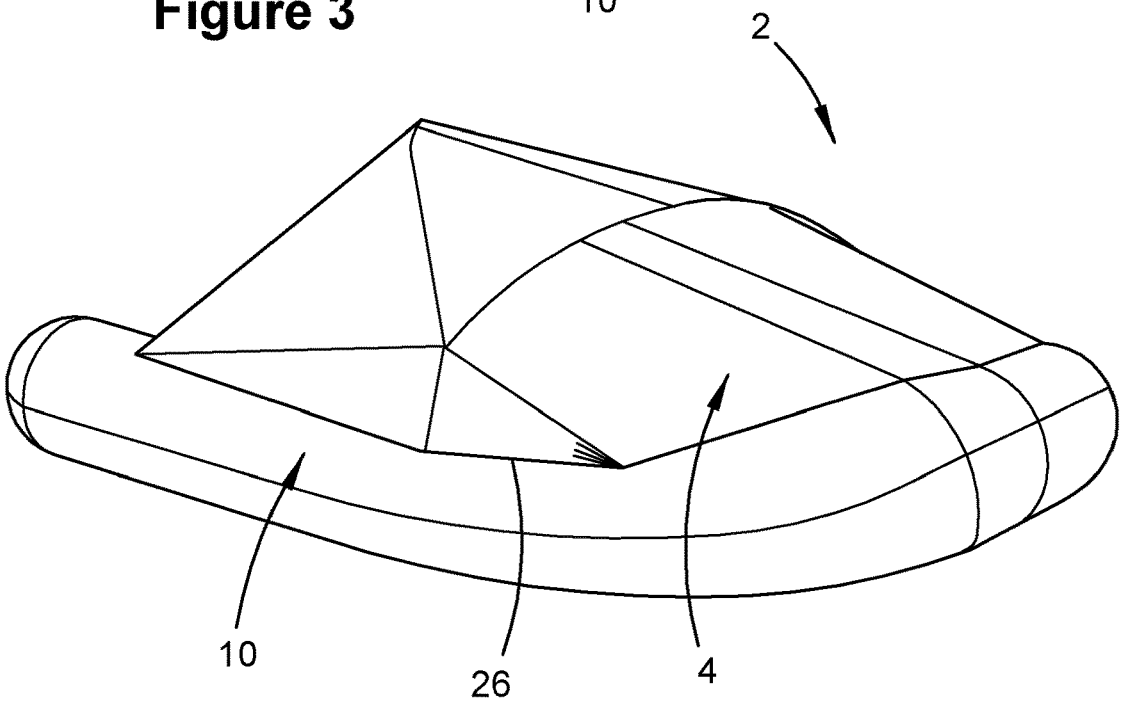
FIG. 4 is a side perspective view of an inflatable tender boat to which is secured a deployed covering according to embodiments of the present invention.

FIGS. 2 to 4 show example applications in which the covering 2 can be used. FIG. 2 shows an example in which the covering 2 is retrofitted to existing support stands 8 to function as an outdoor umbrella. FIGS. 3 and 4 show the covering 2 fitted to an inflatable/tender boat 10. The covering 2 can be collapsed to assume a relatively small volume to be portable and out of the user's way. It is also straightforward to deploy the covering 2 if it is needed to protect, provide shade, shield and so on, depending on the desired application.

Figure 5:
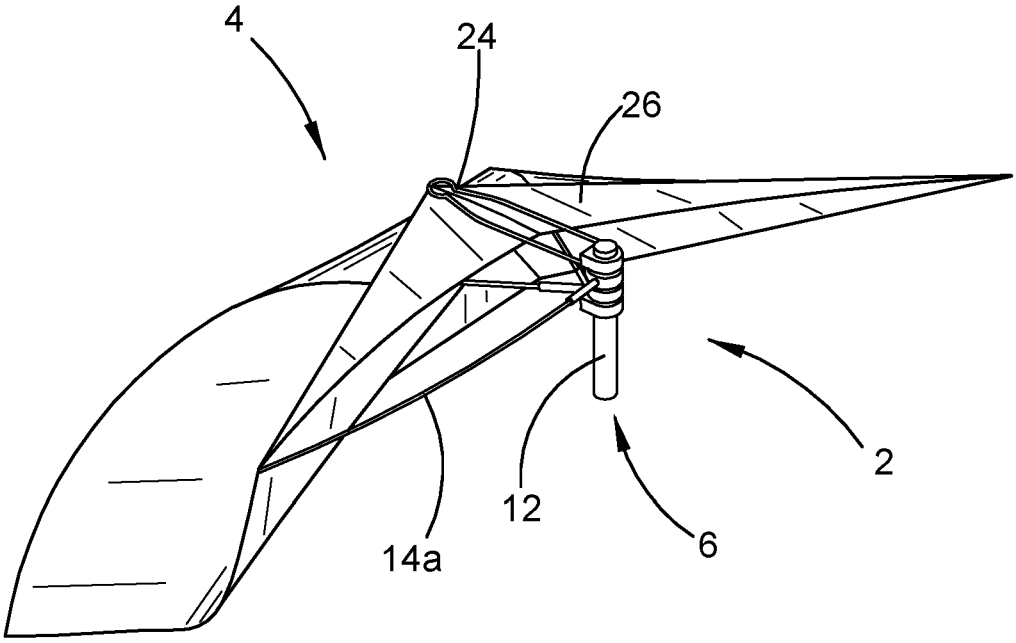
FIG. 5 is a side perspective view of the covering of FIG. 1 in a partially deployed state.

FIG. 5 shows the covering 2 in a partially opened or deployed state. The device 6 of the covering 2 comprises a mount 12 and pivotal spars 14 (14*a*, 14*b*, 14*c*) arranged to secure to the cover 4 and to open and close the cover 4.

Figure 6:
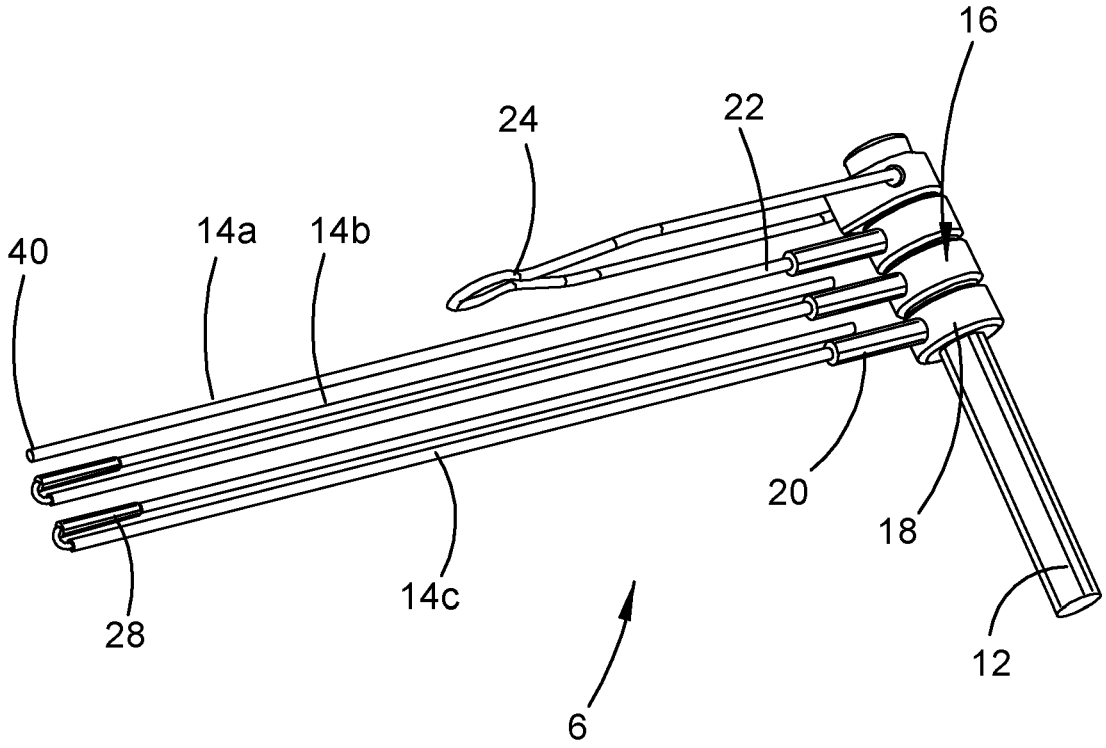
FIG. 6 is a front perspective view of a device for collapsibly supporting a cover according to embodiments of the present invention, the device shown in a collapsed state.

FIG. 6 shows a view of the device 6 of FIG. 5 with the cover 4 removed. The device 6 comprises a mount 12, depicted as an elongate axle or rod. The mount 12 carries three spar-holding support heads 16. Each support head 16 is formed with a cylindrical body 18 which receives the mount 12 and enables the support head 16 to rotate or pivot about the mount 12.

Each support head 16 comprises a spar-receiving arm 20 which protrudes outwardly from the cylindrical body 18. Each arm 20 is configured to receive a first end 22 of a respective spar 14 in a releasably lockable manner. As such, if a spar 14 breaks or is not functioning properly, it can be removed from the device 6 and replaced with a new spar 14. Additionally, the arms 20 engage with respective spars 14 in a rotationally locked manner such that the spars 14 resist torsion and are not able to rotate within the arm 20.

The spars 14 are resilient and flexible such that they can be deflected away from their longitudinal axes. This assists with imparting tension to the cover 4 and helps the cover 4 maintain its shape when opened, as will be discussed.

In a preferred embodiment, the mount 12 also comprises a tensioning means 24 which is configured to secure to a rear region 26 of the cover 4 to stretch and/or draw it open. This will be discussed in greater detail later.

The cover 4 is configured so that it can be removably secured to the device 6 via the spars 14. For example, the underside of the cover 4 may be configured with thin tubes, pockets or holes for receiving the spars 14, not unlike how spars may be fitted to tents and deflected upwards to provide a resilient dome-like structure.

It is envisaged that one or more spars 14 of the present device 6 may be extendable and retractable; this allows the cover 4 and device 6 to be stored in an even more compact manner when stowed away, and to provide an even greater area of coverage when the covering 2 is open and deployed. To this end, the spars 14 may be provided with means which enable it to retract and extend, such as telescoping or folding means. For example, FIG. 6 shows a device 6 comprising two spars 14*b*, 14*c* in a folded state, but which can unfold to assume the deployed state, as shown in FIGS. 7 and 9 through 12.

Figure 8A:
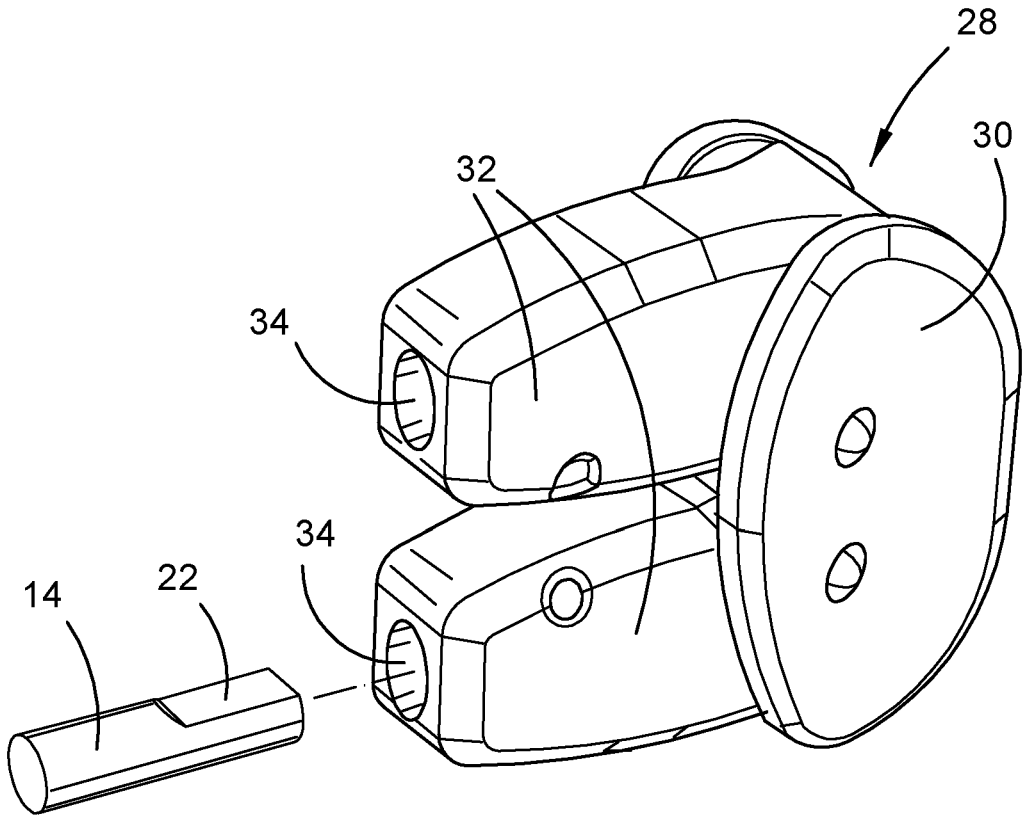
FIG. 8(*a*) shows a front perspective view of a mechanism configured for deploying and collapsing a spar, the mechanism in the collapsed state.
Figure 8B:
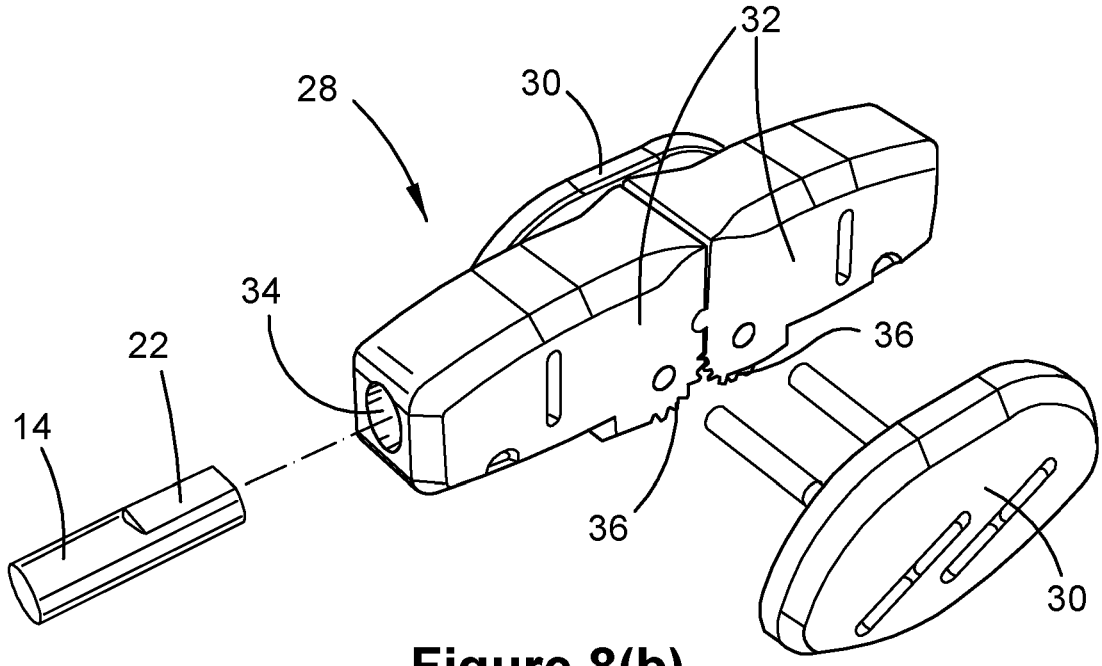
Figure 9:
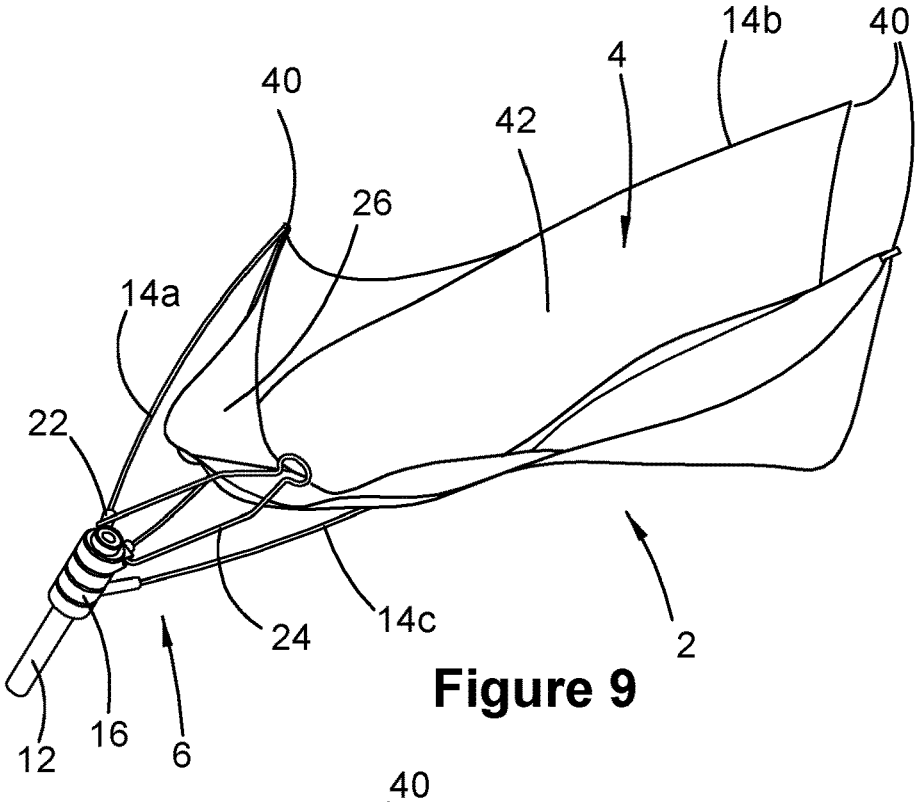
FIG. 9 shows a covering according to embodiments of the present invention, the covering show in a second partially opened state.

FIGS. 8(*a*) and 8(*b*) show a double-hinged geared joint 28 which acts as an intermediate connector between two spars 14. The joint 28 comprises a support plate 30 and two arms 32 hingedly connected to the plate 30. Each arm 32 comprises an opening 34 for receiving the first end 22 of a respective spar 14. The arms 32 are configured to engage a respective spar 14 in a rotationally locked manner such that the spars 14 cannot rotate within the arms 32. Effectively, the joint 28 is configured such that it secures spars 14 thereto in such a way that the spars 14 resist torsion and are prevented from rotating about their own longitudinal axes.

FIG. 8(*a*) shows the joint 28 in a folded or retracted state, such that the two lengths of spars 14 carried by the joint 28 would be folded together, one atop the other. In this state, the cover 4 to which these lengths of spars 14 are secured would similarly be folded up. Biasing means, such as an elastic cord or spring may be provided to bias the joint 28 to remain in the folded or retracted state. In certain embodiments, biasing means in the form of, for example, shock cords, may extend from the spar-receiving arms 20 and engage respective joints 28 to bias the spars 14 to assume their retracted states.

FIG. 8(*b*) shows the joint 28 in an unfolded, extended or open state, wherein the arms 32 of the joint 28 have been pivoted away from one another. In this configuration, the two spars 14 are held by the joint 28 such that they are substantially collinear. By extending the joint 28 and thus the spars 14 from the folded position, it similarly opens and spreads the cover 4 to which the spars 14 are secured. In preferred embodiments of the joint 28, the inner surfaces of the two arms 32 are provided with respective geared teeth 36 which mesh such that pivoting one arm 32 also pivots the other.

FIG. 6 shows the device 6 in a collapsed state, wherein the spars 14 are retracted and substantially aligned in a common angular direction. The cover 4 (not shown) which would be secured to the spars 14 would thus be folded up compactly for easy storage. It is envisaged that the device 6 is provided with stopping means to maintain the spars 14 in their collapsed state. For example, there may be one or more stoppers which abut against the support heads 16 which prevents them from rotating beyond a certain angle, thereby retaining each support head 16 and thus spar 14 at a substantially common angle. In one embodiment, one or more of the spar-receiving arms 20 may comprise a vertically extending tab (not shown) against which an adjacent spar-receiving arm 20 can abut so as to enable stacking of the spars 14 in a common direction. To move the device 6 into the open state to open and deploy the cover 4, the spars 14 are pivoted about the mount 12 and relative to one another such that the spars 14 are angularly spaced from one another.

Figure 11:
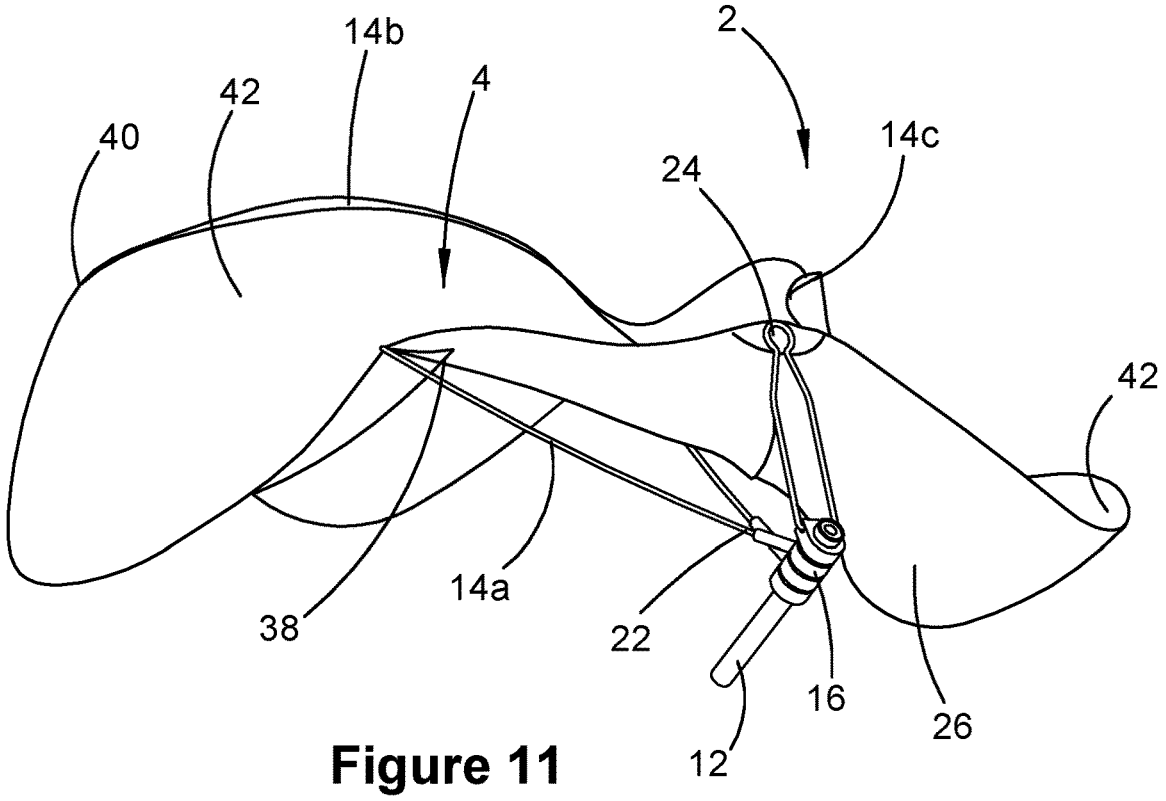
FIG. 11 shows the covering of FIG. 10 in a fourth partially opened state.
Figure 12A:
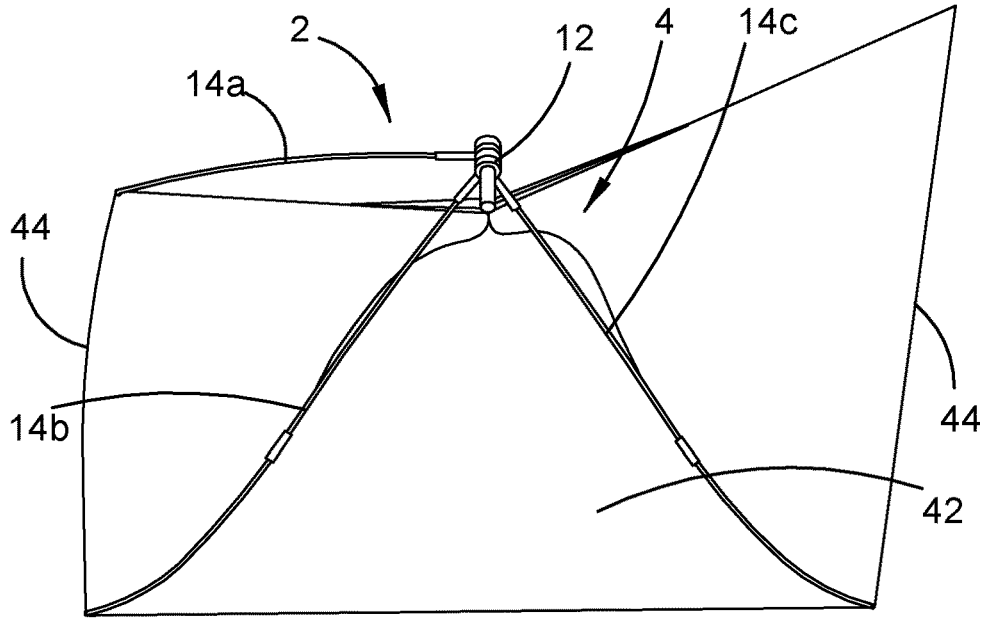
FIG. 12(*a*) shows a bottom perspective view of the covering in a fifth partially opened state.
Figure 12B:
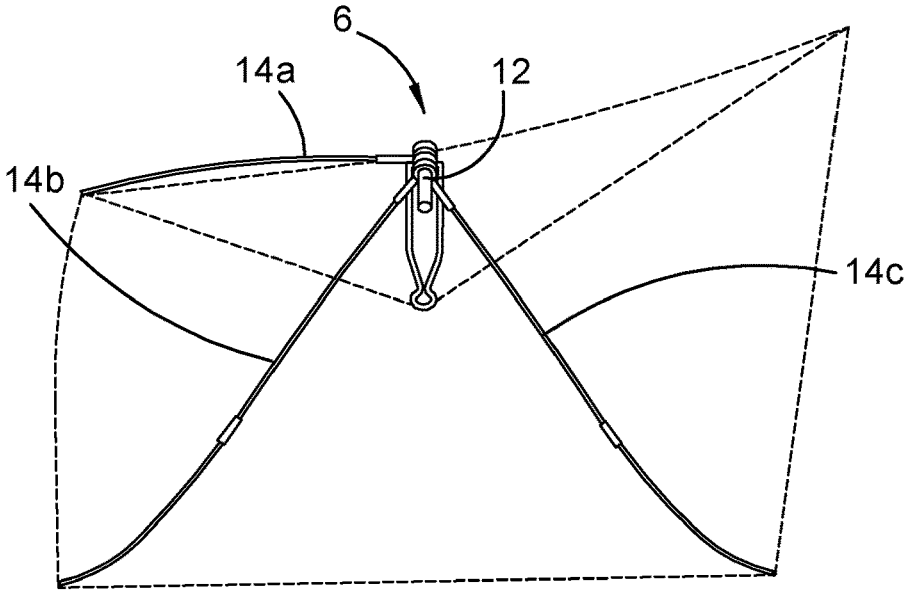
Figure 13:
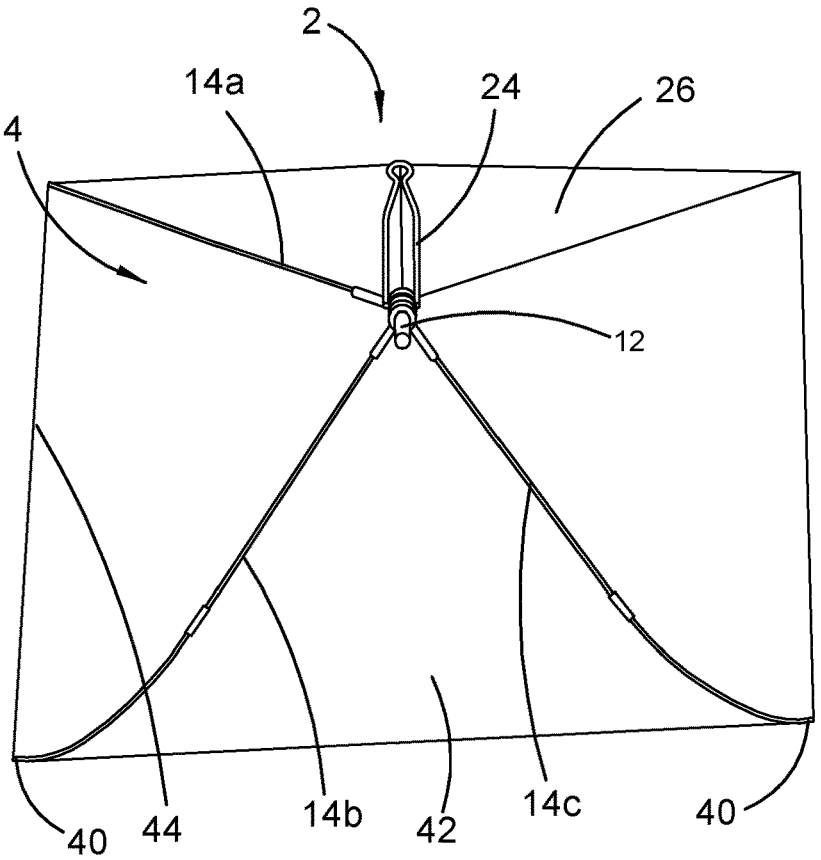
FIG. 13 shows a bottom perspective view of the covering of FIG. 12(*a*) in a deployed or opened state.

FIGS. 7 and 9 to 13 are a sequence of views showing the present covering 2 opening from a first partially deployed state (FIG. 7), to a fully open and deployed state (FIG. 13).

Figure 7:
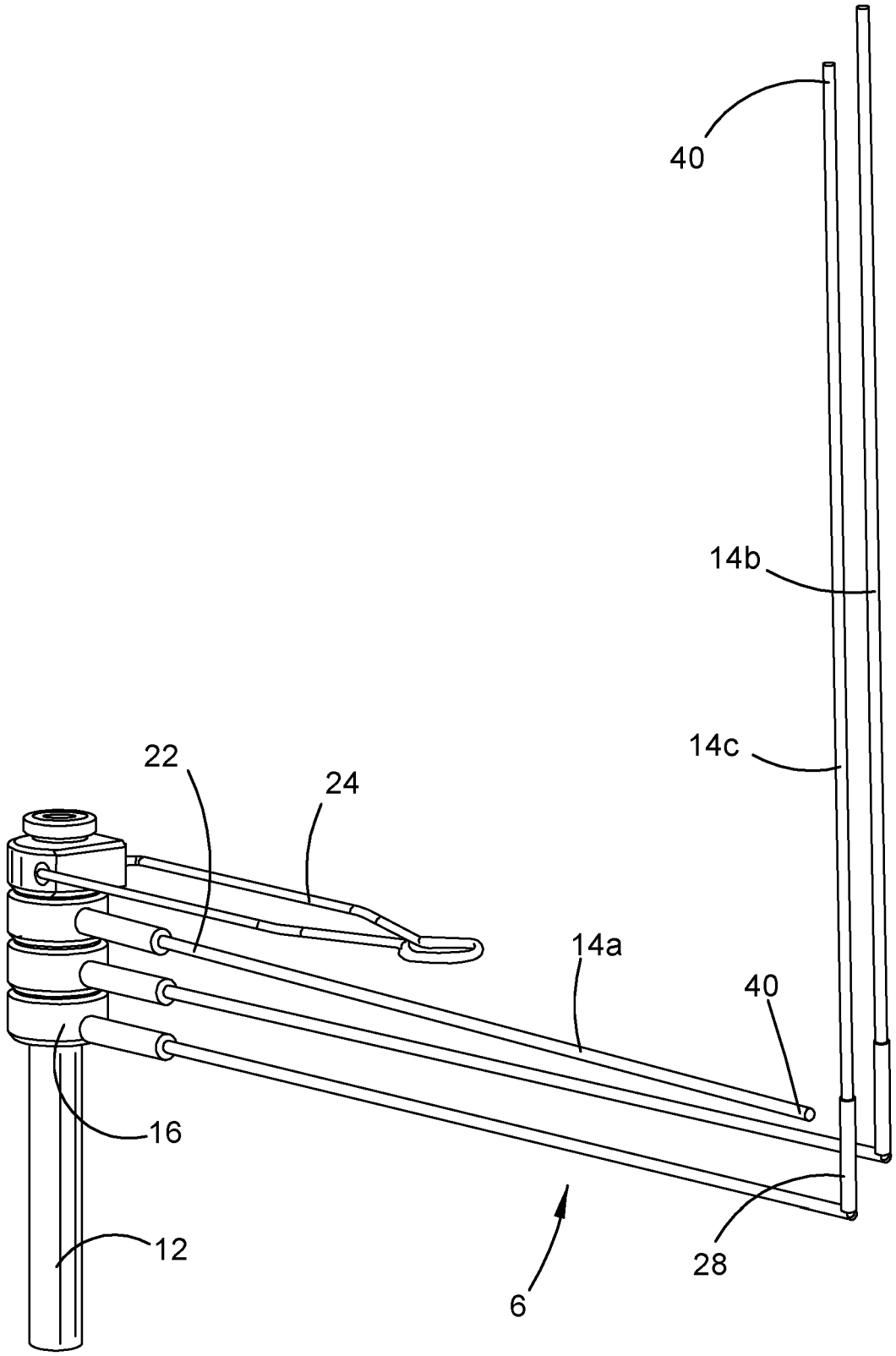
FIG. 7 is a top perspective view of the device of FIG. 6, the device shown in a first partially deployed or opened state.

Referring to FIG. 7 (in which the cover 4 is not shown), the device 6 comprises a lateral spar 14*a* and two foldable or retractable frontal spars 14*b*, 14*c*. Referring to FIG. 11, the lateral spar 14*a* is secured to a lateral rearward region 38 of the cover 4. In particular, a second end 40 (opposite to the spar's first end 22) of the lateral spar 14*a* is secured to an outer lateral rearward region 38 of the cover 4. For example, it could be positioned within a pocket or hole proximate to the periphery of the cover 4.

The two frontal spars 14*b*, 14*c* are secured to frontal regions 40 of the cover 4; the second opposite ends 40 of the frontal spars 14*b*, 14*c* may similarly be secured to frontal areas 42 of the cover 4 proximate to its periphery. In some embodiments, the spars 14 can extend to the perimeter of the cover 4, but in other embodiments, they may not. The device 6 is thus openable from the collapsed state by pivoting each of the three spars 14 from the collapsed state, wherein the lateral spar 14*a* is pivoted out to the side, and the two frontal spars 14,b 14*c* are pivoted out towards the side and front of the covering 2, as shown in FIG. 13.

In embodiments where the spars 14 are relatively stiff and may need assistance deflecting, the device 6 may be provided with one or more cords, lines or threads (not shown) having a first end that extends from, for example, respective spar-receiving arms 20, and a second end engaged with a respective spar 14 toward or at a second end 40 thereof. The effective length of the thread or cord is preferably shorter than that of the corresponding spar 14 to which it is engaged such that, when deploying the covering 2, the cords are drawn taut and pull inwardly on the second ends 40 of respective spars, thereby helping the spars 14 deflect upwardly. One or more restraining loops may be provided to help the cord(s) stay bound or proximate to respective lines. A sleeve may be provided around one or more spars 14 to help prevent fouling.

Figure 10:
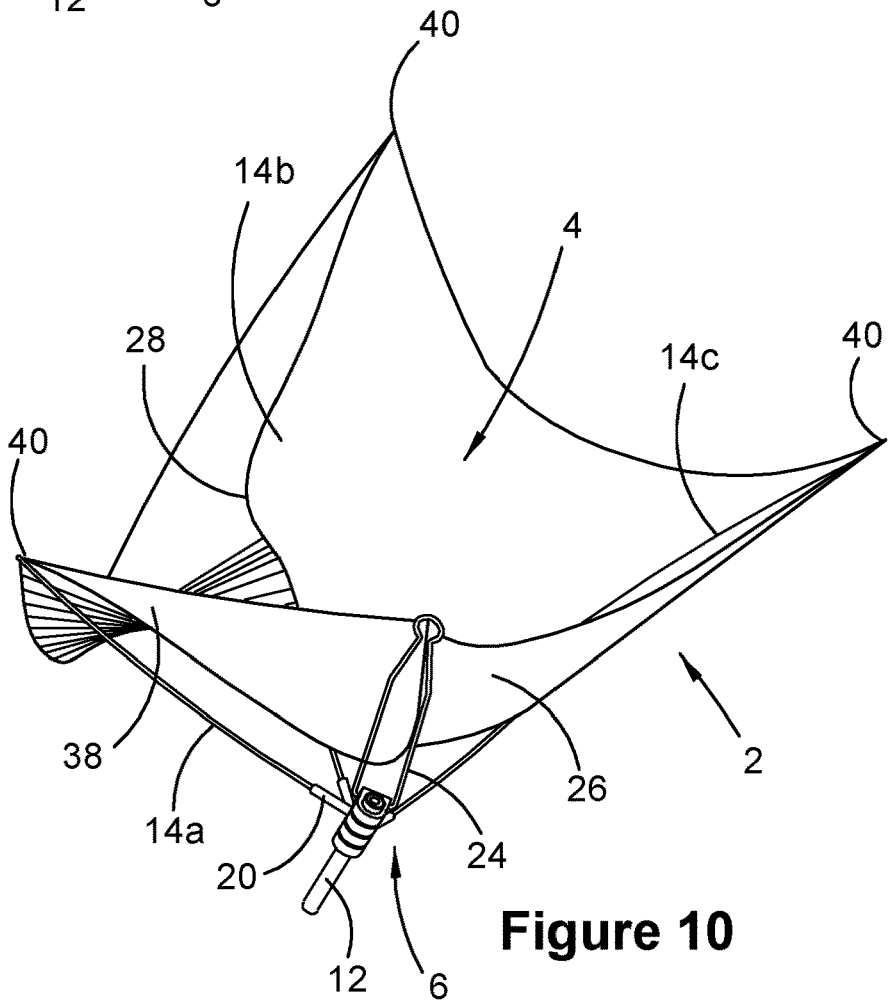
FIG. 10 shows the covering of FIG. 9 in a third partially opened state.

Referring to FIG. 12(*a*), the covering 2 is almost fully deployed in that the lateral and frontal regions of the cover 4 are substantially spread open; the spars 14 have been pivoted about the mount 12 and angularly from each other to fan the cover 4 open. However, a rearward region 26 of the cover 4 remains undeployed. This rearward region 26 of the cover 4 is configured to secure to the aforementioned tensioning means 24 of the mount 12, as shown in FIGS. 10 and 11.

Figure 14:
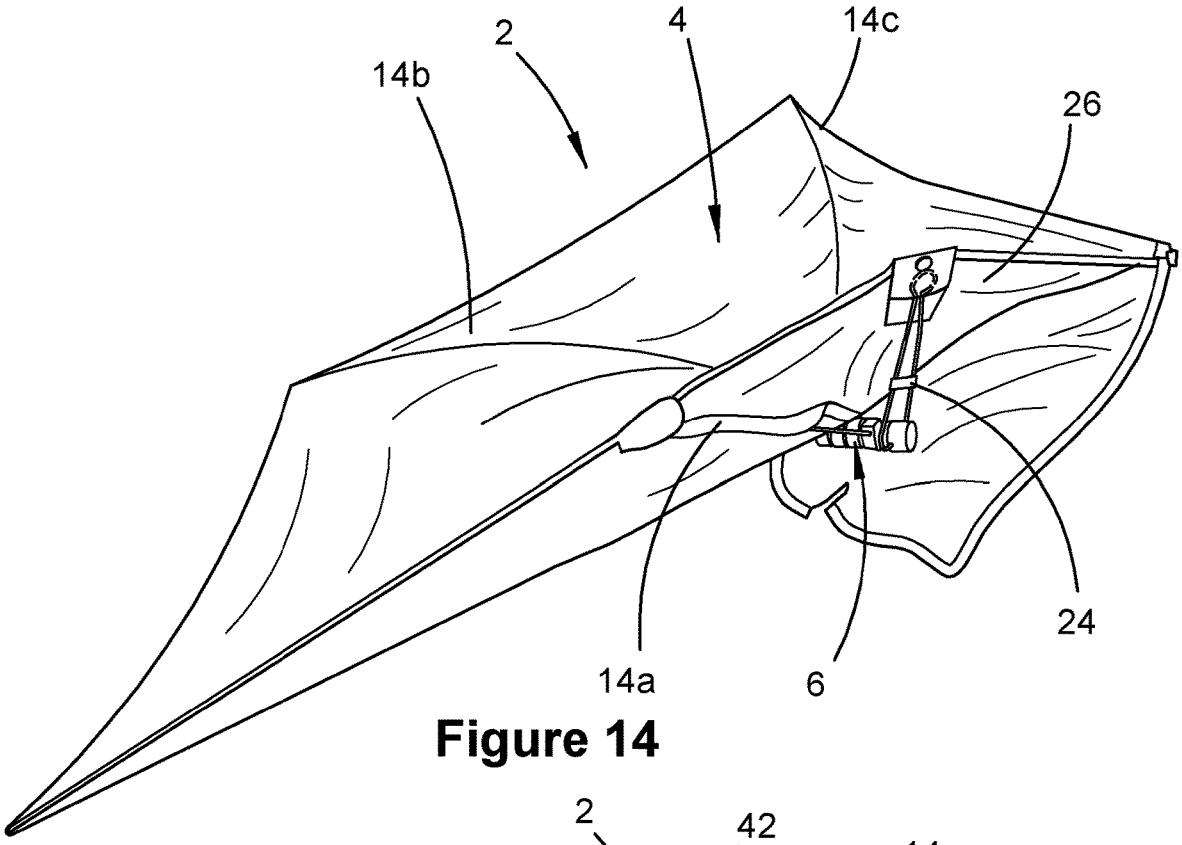
FIG. 14 shows a rear perspective view of a covering according to embodiments of the present invention in a partially deployed state.
Figure 15:
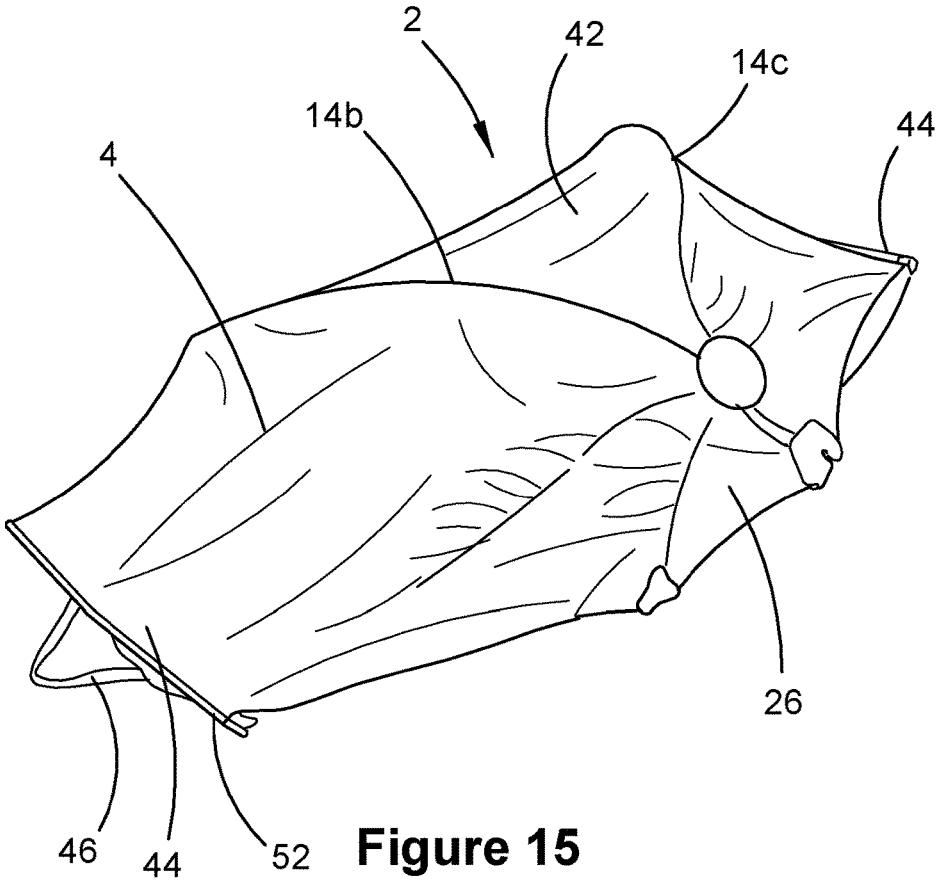
FIG. 15 shows a rear perspective view of the covering according to FIG. 14 in a deployed or opened state.

Referring to FIG. 6, the tensioning means 24 comprises an arm 24 which is pivotal about an axis that is substantially orthogonal to both the longitudinal axis of the mount 12 and the longitudinal axes of the spars 14 when the device 6 is in the collapsed state. That is, in the collapsed state, each of the spars 14 and the tensioning arm 24 are aligned in a common radial direction which points forward in the direction of a frontal region 42 of the cover 4 were it to be deployed. To move the device 6 into the open state, the spars 14 are pivoted about the mount 12 to fan the front and sides of the cover 4 open, whilst the tensioning arm 24 is pulled or pivoted or levered rearwards, thereby drawing the rearward region 26 of the cover 4 down and tensioning the cover 4. This pivoting over and drawing down of the tension arm 24 is shown in FIGS. 13 to 15. FIG. 14 shows the frontal and lateral regions of the cover 4 already open and deployed, whereas the rearward region 26 of the cover 4 remains undeployed. The rearward region 26 can thus be pulled downwardly via the pivoting tension arm 24 or via a rear peripheral region of the cover 4, thereby fully deploying and opening the cover, as shown in FIG. 15.

It is envisaged that for the covering 2 and device 6 to stay in the open state, tension should be applied to at least one outer region of the cover 4, such as the perimeter thereof, to draw it downwardly and inwardly against the frontal spars. Referring to FIG. 15, such tension may be applied by securing opposite lateral sides 44 of the cover 4 to respective anchor points. In FIG. 15, a left-side loop of material 46 at an underside of the cover 4 has been strapped around an anchor point to stretch the cover 4 open and impart tension to it. The right-hand side 44 of the cover 4 is similarly anchored to stretch the cover 4 open laterally and draw it downwardly against the frontal spars 14*b*, 14*c*. This tensioning of the cover 4 acts to urge the frontal spars 14*b*, 14*c* downwardly and inwardly towards the mount 6, including the second opposite ends 40 thereof, such that the frontal spars 14*b*, 14*c* deflect and bow, thereby urging the cover 4 upwardly and away from a plane defined by the perimeter of the opened cover 4. As such, when the covering 2 and thus device 6 are moved into the open state, the cover 4 is stretched open and maintains its dome-like shape via a combination of the downward pulling and inward pulling action from the anchor points and tensioning means 24, the upward and outward urging of the frontal spars 14*b*, 14*c*, and the outward lateral urging of the lateral spar 14*a*. It is envisaged that the seconds ends 40 of one or more spars 14 need not be restrained or secured to an anchor point or surface. Instead, the spars 14 can maintain their arched shape in their flexed state of tension above the area being covered. In some embodiments, to effect simultaneous deployment of both the frontal 42 and rearward regions 26 of the cover 4, an outer region of the cover 4 may first be anchored (e.g. the left-side loop 46 could be strapped around an anchor point to stretch the cover 4 open and impart tension to it). Subsequently, the frontal region 42 of the cover 4 may be fanned open simultaneously as the tensioning arm 24 is pivoted over to draw the rearward region 26 of the cover 4 open.

The covering 2 can easily be returned to its collapsed state simply by releasing one or more of the anchor points and/or the tensioning arm 24, thereby releasing tension in the cover 4 such that the tensioning arm 24 and spars 14 can be returned to a home position in the collapsed state wherein they each point in a common radial direction.

Figure 16:
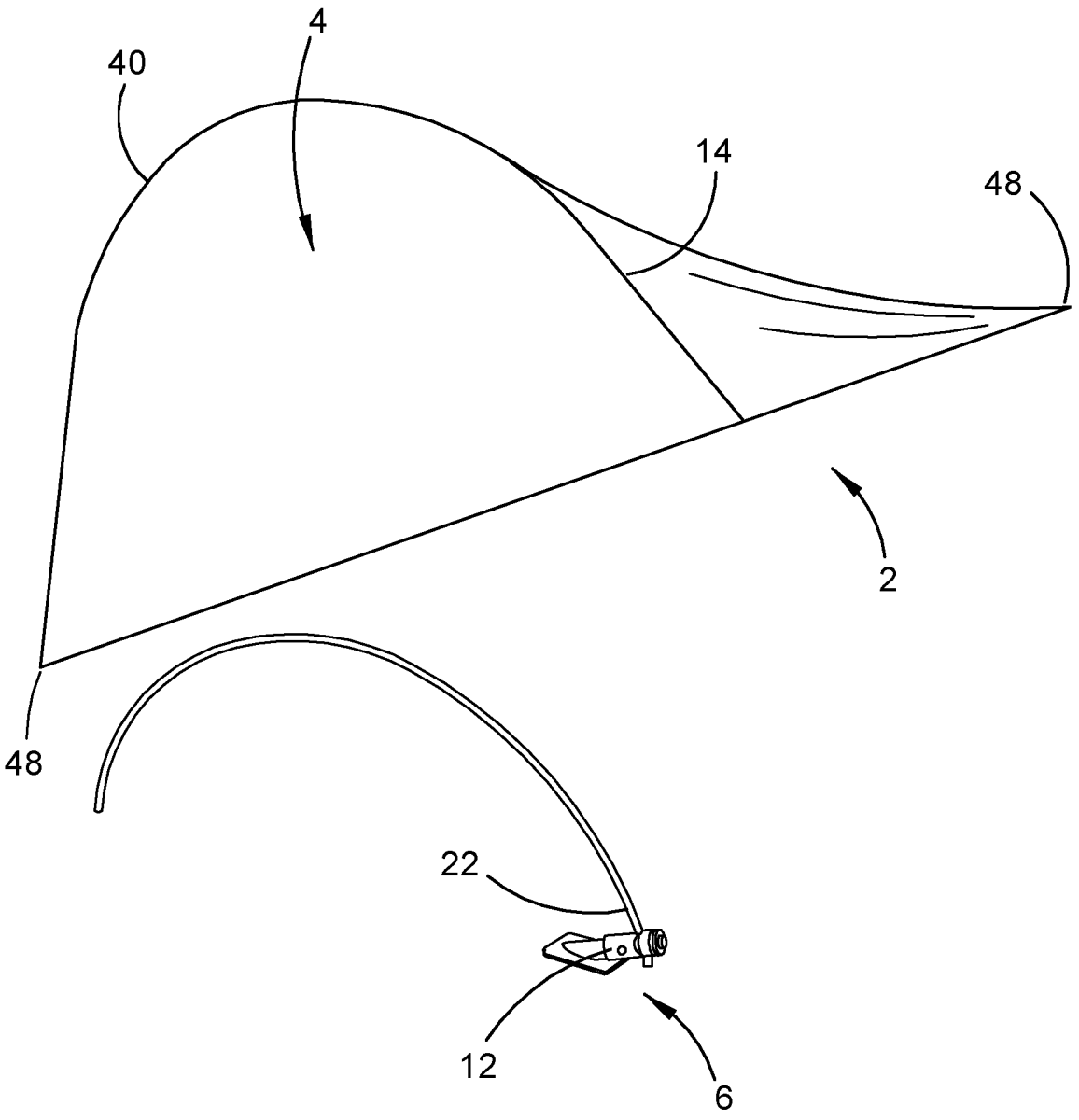
FIG. 16 shows a top perspective view of a covering according to embodiments of the present invention.
Figure 17A:
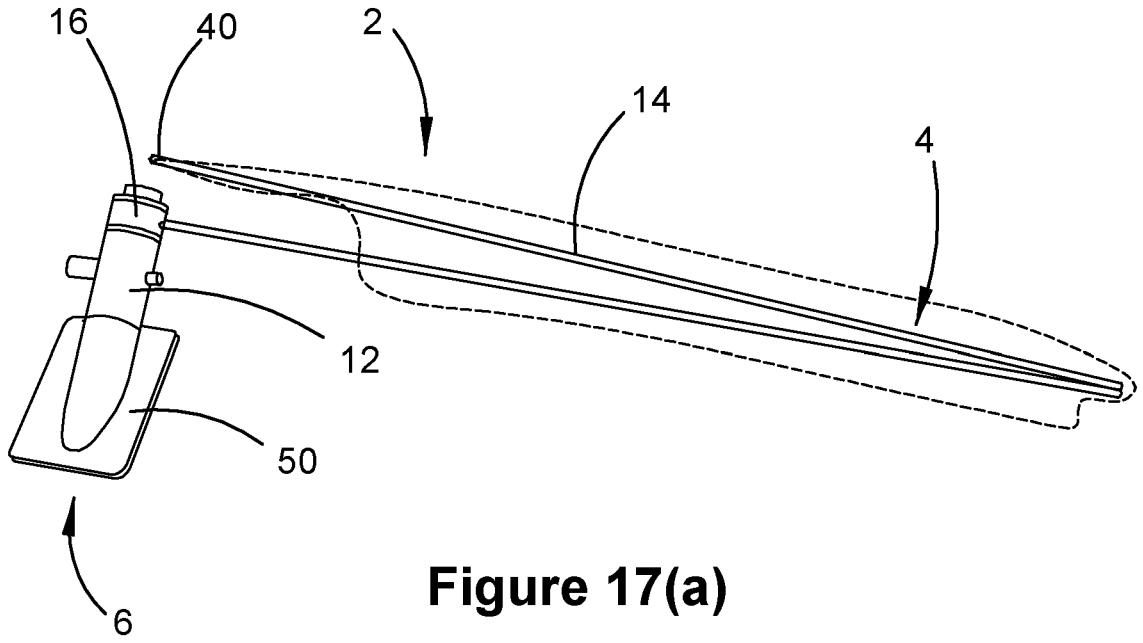
FIG. 17(*a*) shows a front perspective view of the covering of FIG. 16 in a collapsed state.
Figure 17B:
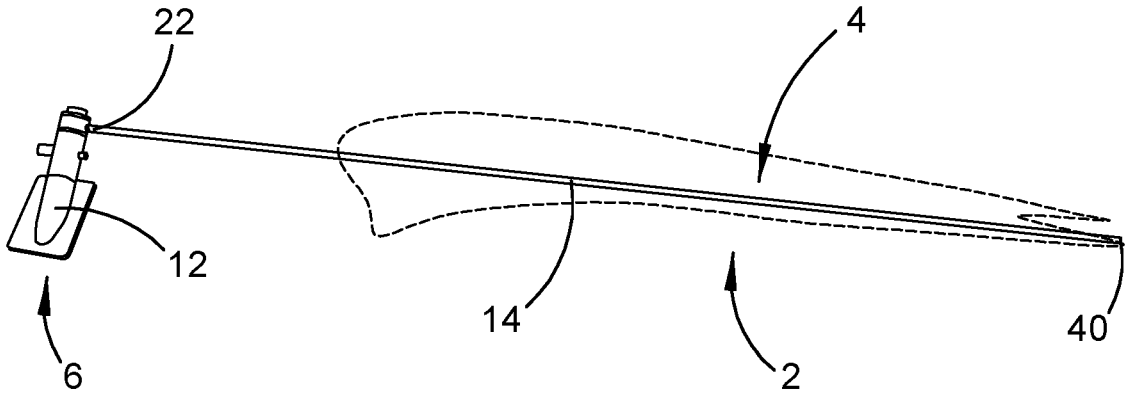
Figure 18A:
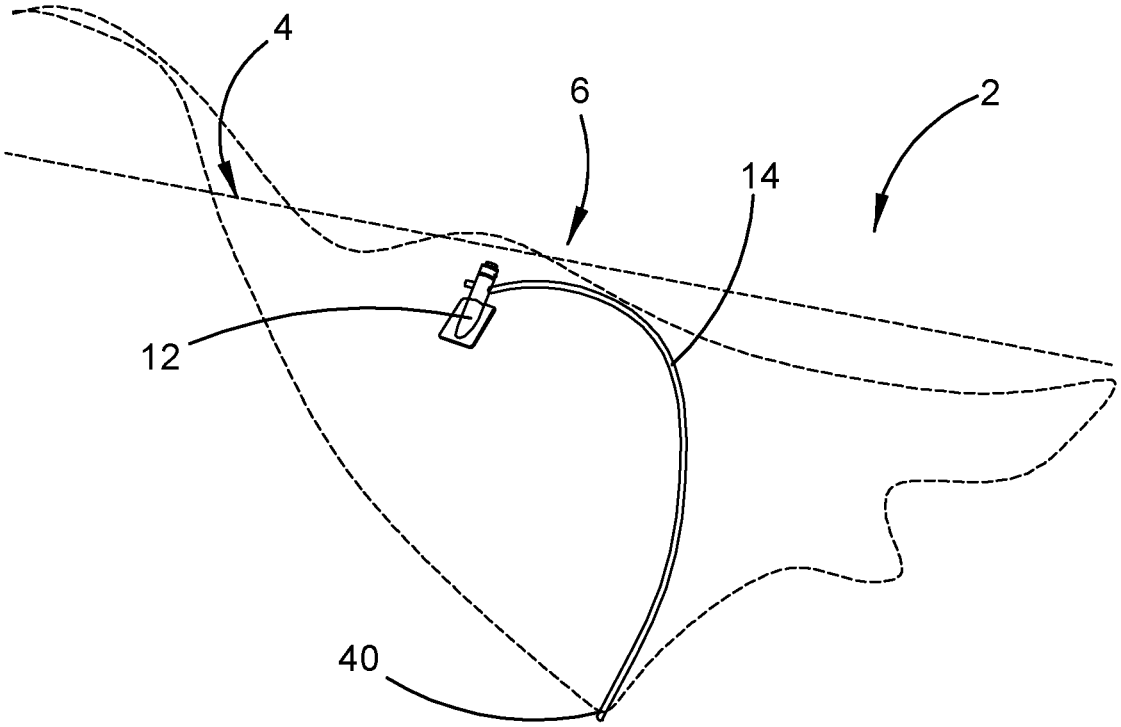
FIG. 18(*a*) shows a front perspective view of the covering of FIG. 17(*b*) in a second partially deployed state.
Figure 18B:
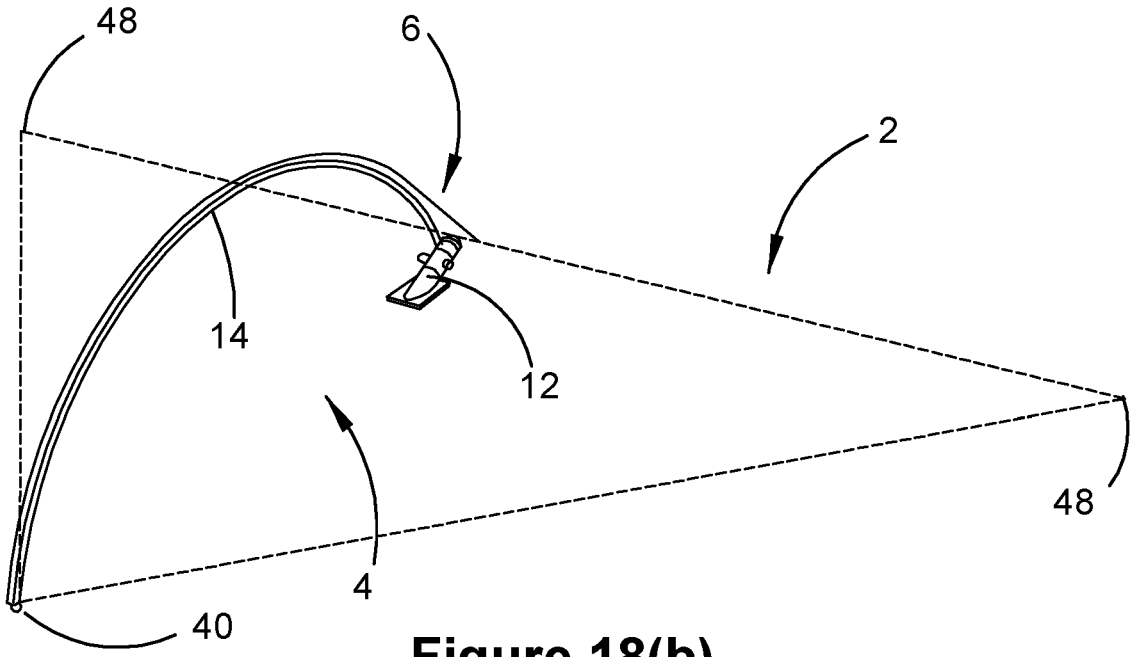

FIGS. 16 to 18 shows an embodiment of a covering 2 wherein the device 6 carries a single pivotal spar 14. In this embodiment, the cover 4 may be generally triangular, wherein in the open state, the outer end or tip 40 of the spar extends forwards to define one "corner" of the triangle. The other two "corners" 48 of the triangular cover 4 may be tied down so that the cover 4 is drawn downwardly against the spar 14, thereby causing it to deflect and urge upwardly against the cover 4.

FIG. 17(*a*) shows the device 6 in a collapsed state, wherein the single spar 14 has retracted or folded, along with the cover 4 (shown in dotted red lines). FIG. 17(*b*) shows the spar 14 unfolded and extending radially from the mount 12.

FIG. 18(*a*) shows the single spar being pivoted about the mount 12 toward a frontal region of what would be the opened covering 2. The second tip end of the spar is engaged with a frontal region of the cover 4 at a periphery thereof. The lateral "corners" of the cover 4 are shown unsecured.

FIG. 18(*b*) shows the covering 2 in a deployed or open state, wherein the spar 14 has pivoted completely to an open position in which it points forward of the rearwardly pointing mount 12, and opposite sides 48 of the cover 4 have been secured to draw the cover 4 downwardly against the spar 14 and to impart tension to the cover 4.

In the described embodiments, the perimeter of the opened cover 4 defines an imaginary plane with reference to which it is important to discuss the orientation of the device 6. Of course, the covering 2 may be spread open to cover irregularly shaped areas wherein the spars 4 may be at various elevations, in which case the perimeter of the cover 4 may define an imaginary two-dimensional curved surface, rather than a flat plane. In either case, in certain embodiments, the mount 12 is angled relative to the imaginary plane or curved surface. In certain embodiments, such as those shown in FIGS. 14, 16 and 18(*b*), the mount 12 preferably extends rearwardly at an angle to a normal of the imaginary plane or curved surface. Additionally, when the device 6 assumes an open state, it is preferable for the or each spar 14 to extend at approximately right angles from the mount 12 so that the cover 4 can act to pull downwardly on the spar, causing it to arch and deflect and urge upwardly against the cover 4. For example, in FIG. 18(*b*), it can be imagined that if the cover 4 was not present, the spar 14 would be relaxed and point in a direction that is roughly at 90 degrees from the longitudinal axis of the elongate mount 12. The downward urging of the cover 4 (by anchoring its opposite lateral ends 48) thus drags or pulls the single spar 14 downwardly, causing it to flex and push upwardly against the cover 4 to impart tension and provide it with a dome-like shape. Of course, the aforementioned 90-degree angle between the mount 12 and the or each spar 14 is not strict, and angles greater or less than 90 degrees would also work, depending on the desired shape of the cover 4 and the tension therein.

Many modifications of the above embodiments will be apparent to those skilled in the art without departing from the scope of the present invention. For example, the device 6 may comprise limiting means which limit the maximum angular displacement or rotation of the or each spar 14 when they are pivoted from the collapsed to the open state. As such, to move the device 6 into the open state, one spar may only be limited to pivoting to a first angle, whereas another spar may only be able to pivot to a second and smaller angle. The limiting means could be in the form of one or more stoppers associated with the mount 12 which abut against and block the support heads 16 from rotating beyond a certain angle. Alternatively, the support heads 16 may have a keyed engagement with the mount 12 which controls their range of movement. It is also envisaged that the spars 14 may be pivotal inwardly and outwardly, relative to the mount 12, such that the spars 14 can be folded up compactly with the mount 12 when the device 6 is stowed away. For example, the support heads 16 may be configured so allow angular adjustment of the spars 14 relative to the mount 12.

It is also envisaged that the mount 12 may be fixedly or movably mounted to a surface, stand, or some other support or connecting means, depending on the application of the covering 4. For example, in FIG. 2, the mount 12 could be pivotally secured to the support stand 8 so that the covering 2 can function as an outdoor umbrella. In FIG. 3, for example, the mount 12 may be fixed to a fixture of the boat 10. Alternatively, the mount 12 itself could be pivotally or otherwise movably secured to a base (such as the baseplate 50 shown in FIG. 17(*a*) or other suitable mounting plates or foundations), which base 50 engages with the boat (or other) surface. As such, when the device 6 is to be collapsed and stowed away, it may be pivoted or moved out of the way to save space and reduce its physical footprint.

Figure 19A:
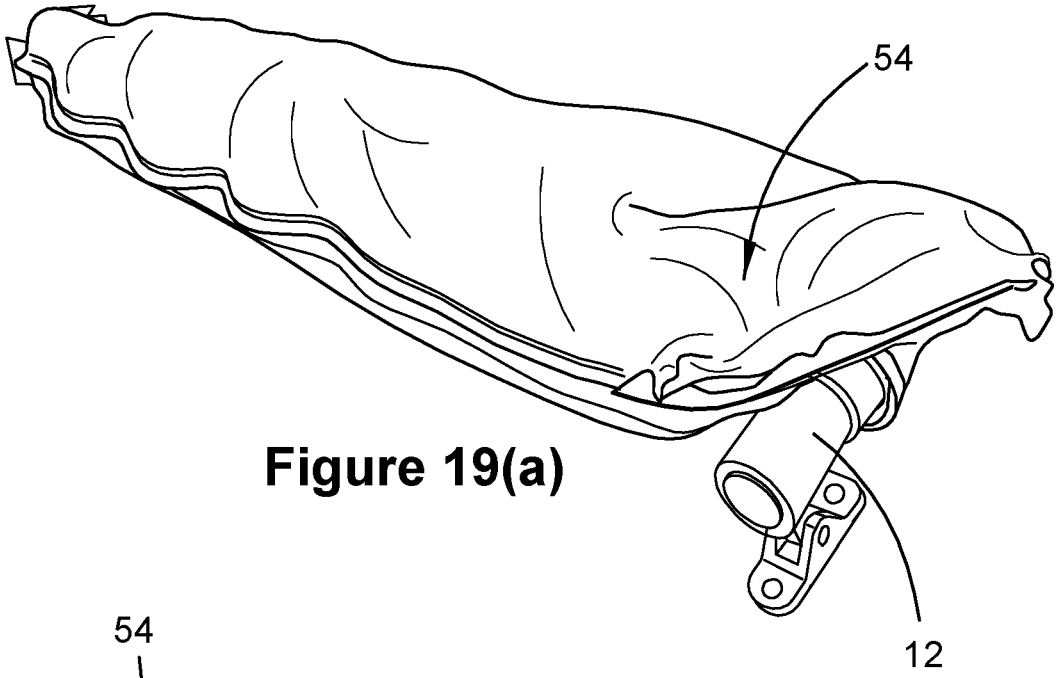
FIG. 19(*a*) shows a side perspective view of an embodiment of a covering stored in a carry bag.
Figure 19B:
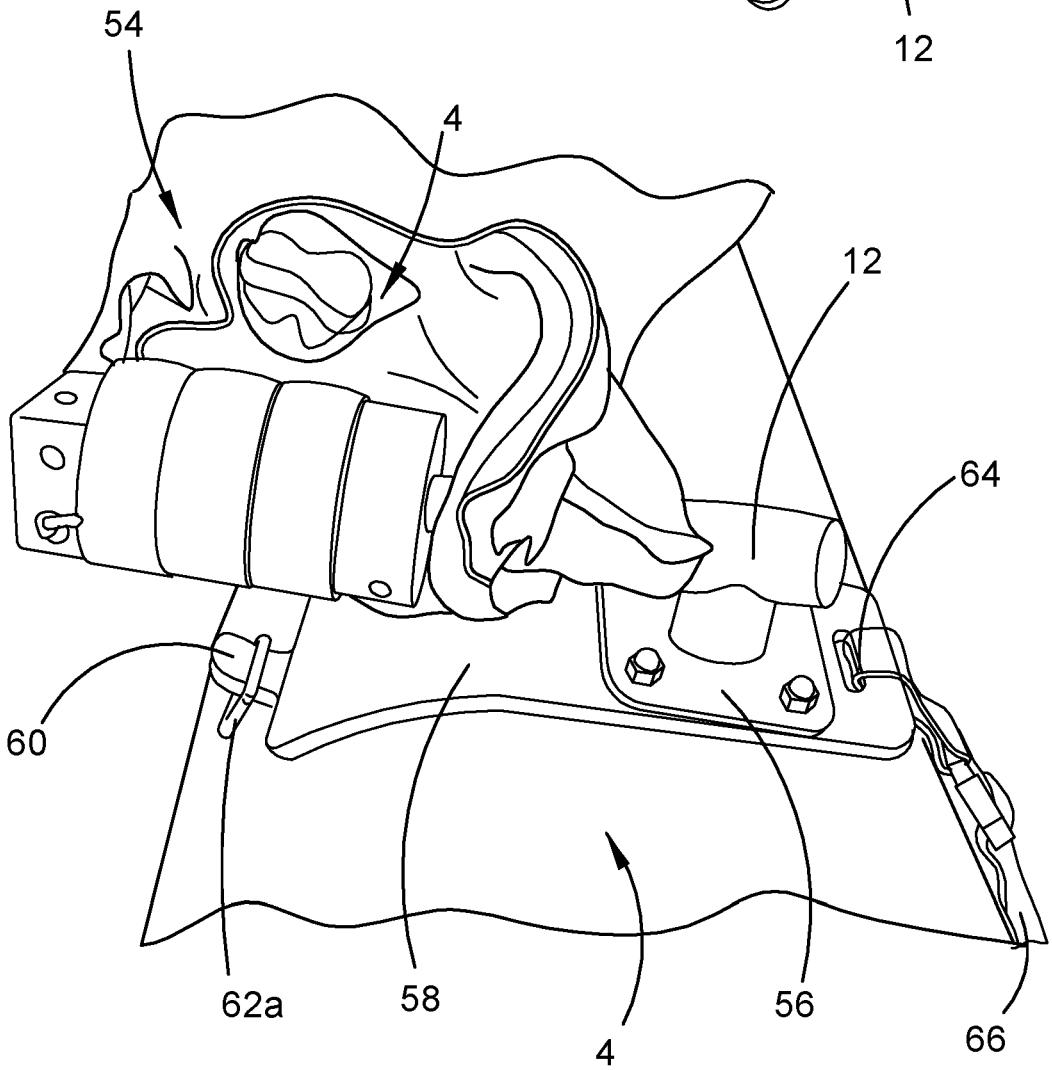
Figure 20:
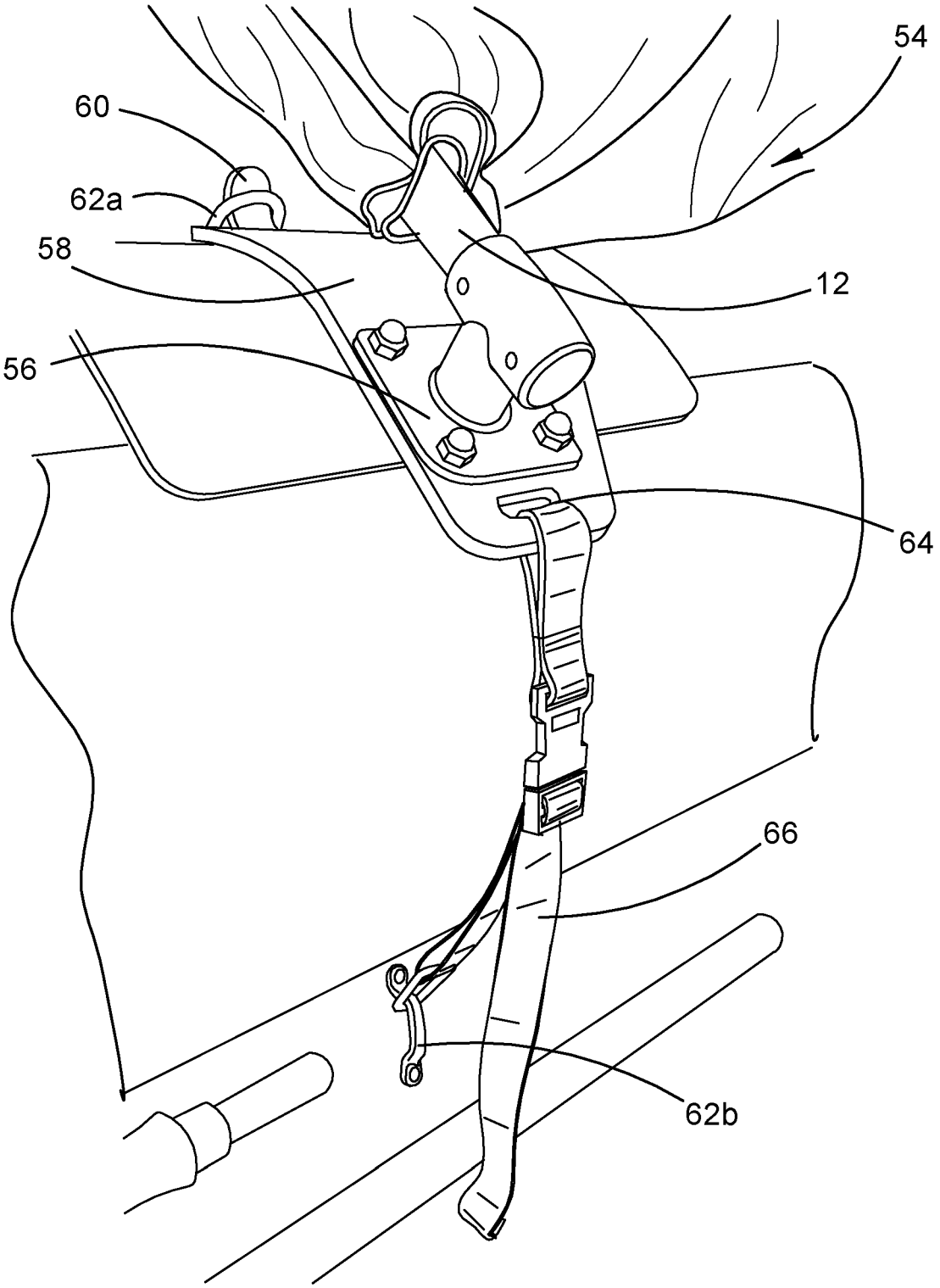
FIG. 20 shows a close-up bottom perspective view of the mounted covering of FIG. 19(*b*)
Figure 21:
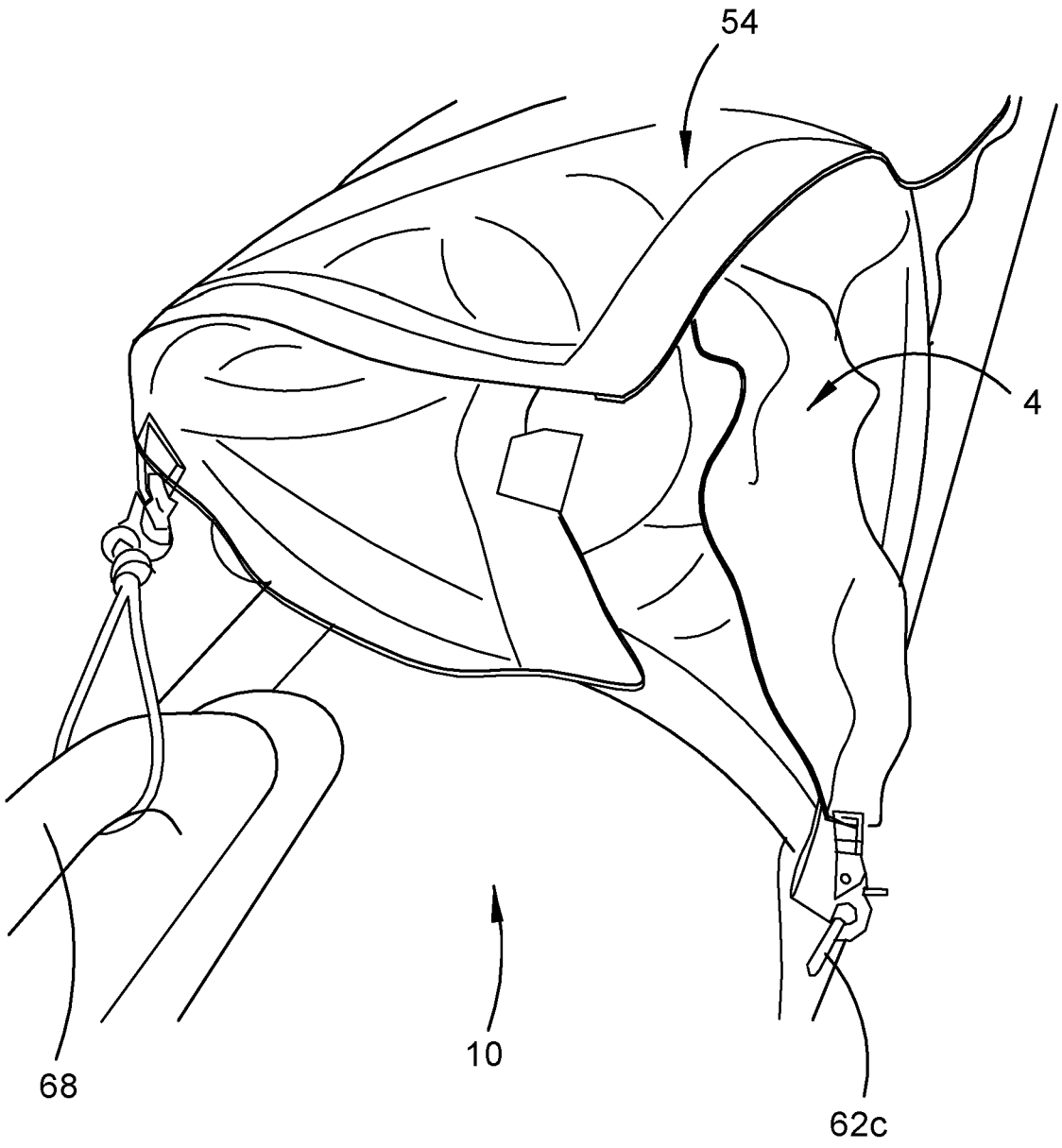
FIG. 21 shows a close-up front view of the mounted covering of FIG. 19(*b*).

With reference to FIGS. 19 to 21, the covering 2 may be stored in a carry bag 54 and deployed therefrom. Referring to FIGS. 19(*b*) and 20, a lower end of the mount 12 is secured to or comprises a mounting or base plate 56. The base plate 56 is preferably oriented such that it lies in a plane that is generally parallel to the longitudinal axis of the mount 12.

The base plate 56 is configured to be secured to a boat mount 58 which is removably securable to fixtures or connection points of a boat 10. For example, in FIG. 19(*b*), a first end of the boat mount 58 comprises an upwardly curving tab 60 arranged to removably engage a D-ring 62*a* of the boat 10.

Referring to FIG. 20, an opposite end of the boat mount 58 can be secured, e.g., via a tether 66, to another structure of the boat 10, such as another D-ring 62*b*. FIG. 21 shows how an opposite end of the bag 54 and cover 4 therein are also releasably mountable to connection points of the boat 10. For example, in FIG. 21, a corner of the cover 4 is clipped to another D-ring 62*c* of the boat 10. Meanwhile, an end of the bag 54 is securable to a handle 68 of the boat 10. The carry bag 54 and covering 2 therein are thus releasably securable to the boat 10 wherein the covering 2 can be neatly stowed within the carry bag 54 to permit ready access to the boat 10. When the boat 10 is no longer in use, the bag 54 can be opened (e.g., unzipped) and the covering 2 can be deployed therefrom to protect the boat 10, as shown in FIG. 4.

While the depicted mount 12 is substantially rigid, it may of course be configured to provide a level of flexibility and resilience, depending on the application. For example, at least a portion of the mount 12, if not the entire mount 12 may be made from a resilient material, such as an elastomeric material.

With reference to FIG. 15, the cover 4 may also be provided with various stiffening means 52, particularly in or towards its periphery, which helps the cover 4 maintain its shape when opened, and facilitate the outward pulling of its lateral sides 44 for securing to anchor points.

Of course, the device 6 may have any number of spars 14, wherein one or more spars 14 may be extendable, retractable or foldable. The device 6 can thus be configured to achieve covering configurations of various shapes and geometries depending on the desired application. Additionally, the spars 14 may be arranged or configured with one or more movable joints (such as the gear joint 28) to enable to the spars 14 to fold up and collapse in a more compact or customisable manner. In certain embodiments, two or more spars 14 may radiate out to open and deploy the device 6, wherein in returning to the collapsed state, seconds ends 40 of the spars 14 may return so as to be connected or in line with one another and attached to a perimeter of the cover 4.

In embodiments with two or more spars 14, it is envisaged that the means which enable the spars to pivot relative to the mount 12 (e.g. support heads 16) may cooperate to enable synchronised opening and closing of the spars 14. In the present embodiments, the support heads 16 may be provided with geared teeth which mesh with each other in such a way that, upon pivoting open one spar, the other spars also pivot open or closed to the appropriate location for the device 6 to achieve the collapsed or open state.

In the Figures, the tensioning means 24 is depicted as an over-centre lever arm secured to an upper end of the mount 12 and being pivotal thereabout. The over-centre mechanism via which the arm is pivoted is configured to lock the lever arm 24 in the open position and prevent it from snapping back or closing, thereby maintaining tension in the drawn down rearward region 26 of the cover 4. Of course, the tensioning means 24 can take other forms and simply needs to function to draw the rearward region 26 of the cover 4 downwardly. For example, the tensioning means 24 could be an elongate track or telescopic member which extends and retracts to stretch out and relax, respectively, the rearward region 24 of the cover 4.

Throughout this specification and the claims which follow, unless the context requires otherwise, the word "comprise", and variations such as "comprises" and "comprising", will be understood to imply the inclusion of a stated integer or step or group of integers or steps but not the exclusion of any other integer or step or group of integers or steps.

The reference in this specification to any prior publication (or information derived from it), or to any matter which is known, is not, and should not be taken as an acknowledgment or admission or any form of suggestion that that prior publication (or information derived from it) or known matter forms part of the common general knowledge in the field of endeavour to which this specification relates.

The invention claimed is:

1. A device for collapsibly supporting a cover, comprising:

a mount having a longitudinal axis;

resilient and substantially radial spars, first ends of which are pivotally associated with the mount about the longitudinal axis thereof, opposite second ends of which are configured to secure to respective outer ends of the cover; and a tensioning means, a first end of which is pivotally associated with the mount about an axis that is generally normal to the longitudinal axis of the mount, an opposite second end of which is configured to secure to a rearward region of the cover, wherein in use, the device is movable from a collapsed state for stowage of the cover, to an open state, wherein:

(a) the spars extend radially outwardly from the mount and fan open relative to one another to spread open frontal and lateral regions of the cover;

(b) tension is applied to an outer region of the cover, thereby drawing the second end of each spar downwardly such that each spar deflects and urges the cover upwardly and away from a plane defined by a perimeter of the opened cover; and (c) the tensioning means is levered rearwardly to draw open the rearward region of the cover.

2. The device of claim 1, wherein at least one spar is retractable for stowage of the cover in the collapsed state, and extendable for spreading the cover in the open state.

3. The device of claim 1, wherein each spar is configured to be pivotal about the mount such that:

(a) in the collapsed state, each spar generally extends in a common radial direction; and (b) in the open state, each spar is pivoted about the mount so as to be angularly spaced from one another.

4. The device of claim 3, wherein in the collapsed state, the tensioning means extends in said common radial direction, and in the open state, is levered rearwardly so as to extend generally in the opposite radial direction.

5. The device of claim 1, further comprising a stopping means configured to maintain each spar at a substantially similar angular position when the device is moved to the collapsed state.

6. The device of claim 1, further comprising a limiting means configured to limit the maximum angular displacement of each spar to a respective and predetermined angular position when the device is moved to the open state.

7. The device of claim 1, wherein tension is applied to the outer region of the cover by securing one or more outer locations of the cover via one or more anchor points to tighten and draw the cover downwardly.

8. The device of claim 1, wherein the mount is pivotal to enable angular adjustment of the plane defined by the perimeter of the opened cover.

9. The device of claim 1, wherein in use, the mount is angled from the normal to the plane defined by the perimeter of the opened cover.

10. The device of claim 1, further comprising a covering secured to the device via the spars thereof.

11. The device of claim 10, further comprising a carrier in which at least a portion of the covering is stowable and/or to which the covering is securable, wherein the covering is deployable from the carrier to substantially cover a boat.

12. The device of claim 11, further comprising a base mount to which the mount of the device is secured, which base mount is securable to the boat.

13. A method of using a collapsible cover, the method comprising:

(a) pivoting multiple resilient and substantially radial spars that are pivotally associated with a mount having a longitudinal axis, about the mount so as to at least partially spread open frontal and lateral regions of a cover;

(b) as each spar is pivoted to at least partially spread the cover open, levering a tensioning means that is pivotally associated with the mount about an axis that is generally normal to the longitudinal axis of the mount rearwardly to draw open the rearward region of the covering, thereby imparting tension to the cover, wherein an opposite end of the tensioning means is configured to secure to a rearward region of the cover; and (c) applying tension to an outer region of the cover, thereby drawing a second end of each spar downwardly such that the spars deflect and urge the cover upwardly and away from a plane defined by the perimeter of the opened cover.

14. The method of claim 13, further comprising securing a base mount to a boat, the base mount being adapted to attach the mount to the boat; and securing a first end of a carrier to the boat such that a covering is at least partially stowed therein, wherein the carrier is adapted to stow at least a portion of the covering therein.

15. The method of claim 14, further comprising securing a first end of the at least partially stowed cover of the covering to the boat.

16. The method of claim 15, further comprising opening the carrier and deploying the covering from the carrier so as to substantially cover the boat.

17. The method of claim 16, further comprising securing a second end of the deployed covering to the boat.

* * * * *